United States Patent [19]

Strongin

[11] 4,303,246

[45] Dec. 1, 1981

[54] TABLE GAME

[76] Inventor: Ned Strongin, 7 E. 35th St., New York, N.Y. 10016

[21] Appl. No.: 140,434

[22] Filed: Apr. 15, 1980

[51] Int. Cl.[3] ..... A63F 3/00

[52] U.S. Cl. ..... 273/271

[58] Field of Search ..... 35/35 H; 273/153 S, 273/156, 241, 271, 239

[56] References Cited

U.S. PATENT DOCUMENTS

| | | | |
|---|---|---|---|
| D. 176,586 | 1/1956 | Bogenberger | 35/35 H X |
| 1,571,856 | 2/1926 | Mahurin | 273/153 S X |
| 2,708,580 | 5/1955 | Hamilton | 273/239 X |
| 3,192,650 | 7/1965 | Torchia | 273/153 S X |
| 3,778,063 | 12/1973 | Strand | 273/271 X |
| 3,888,487 | 6/1975 | Replogle | 273/241 |

FOREIGN PATENT DOCUMENTS

| | | | |
|---|---|---|---|
| 602970 | 8/1960 | Canada | 273/241 |
| 797013 | 6/1958 | United Kingdom | 273/241 |
| 1109204 | 4/1968 | United Kingdom | 273/241 |

*Primary Examiner*—Harland S. Skogquist

[57] ABSTRACT

A table game is provided in which a pair of players alternate in sliding flat game pieces onto a game board, between the top surface of the game board and a transparent cover. The game board is divided into a matrix of channels along which the game pieces slide and a game piece entering a completely filled channel forces the game piece at the far end of the channel to fall off the base. The first player to completely fill a row, or a column or a diagonal of the matrix with his game pieces is declared the winner.

9 Claims, 5 Drawing Figures

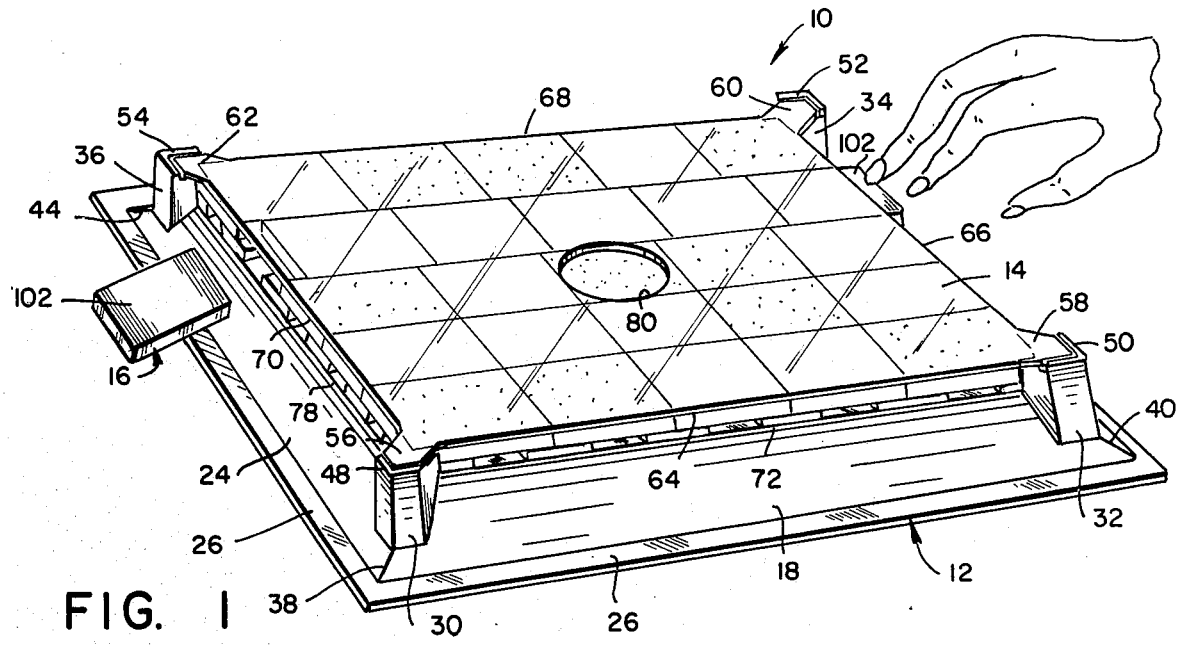
FIG. 1
FIG. 3
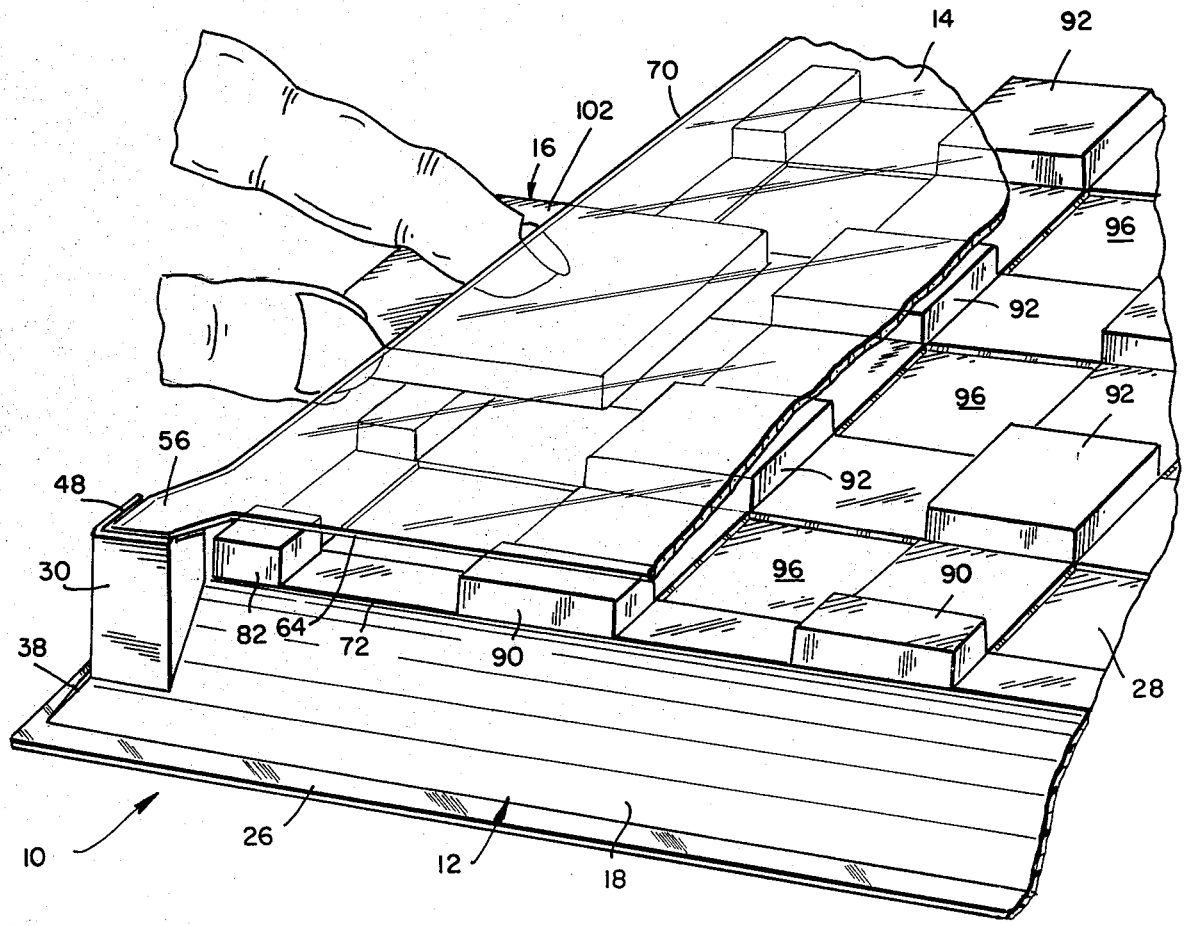

FIG. 2
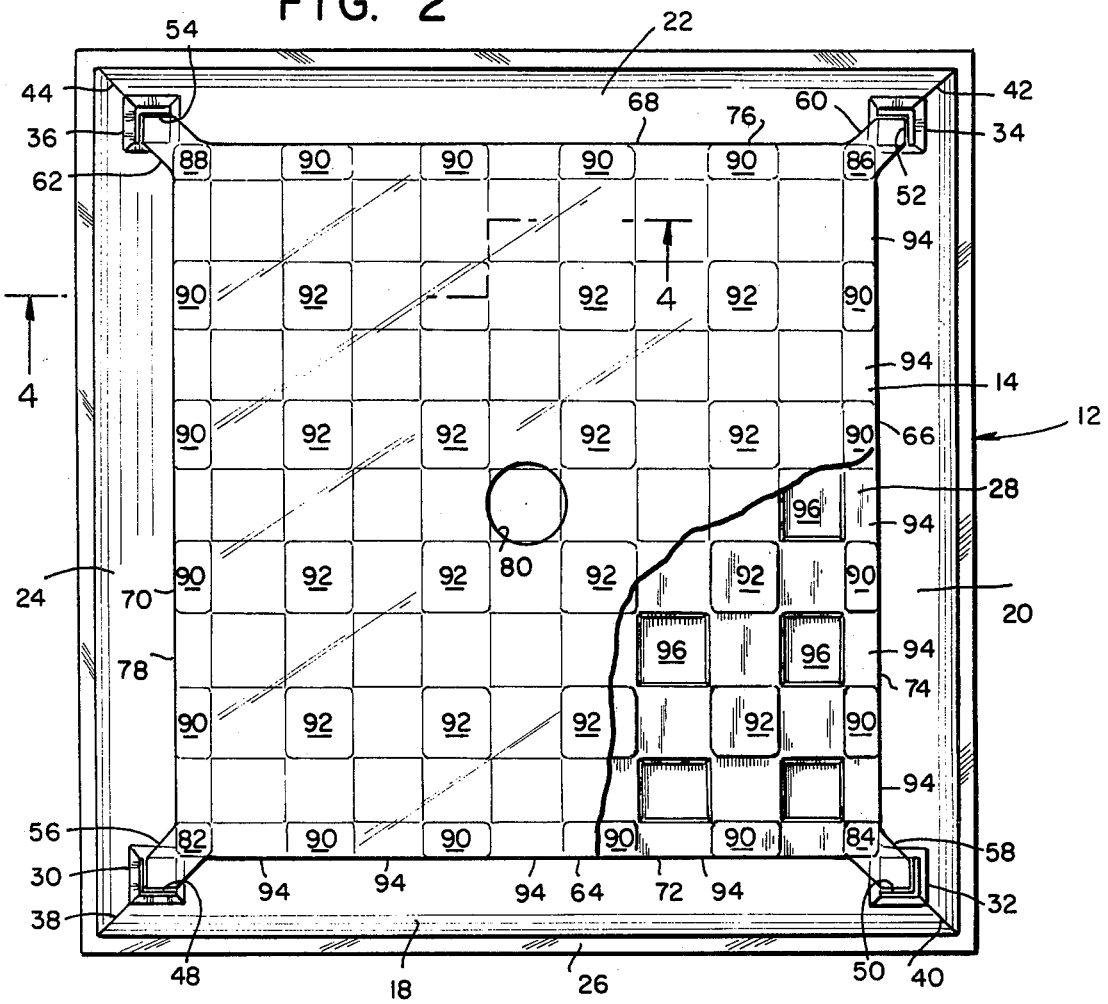
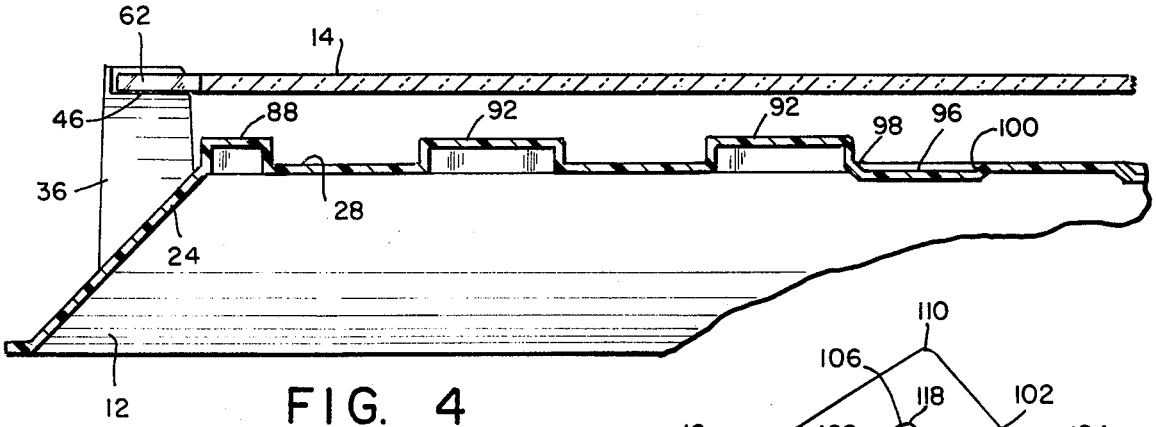
FIG. 4
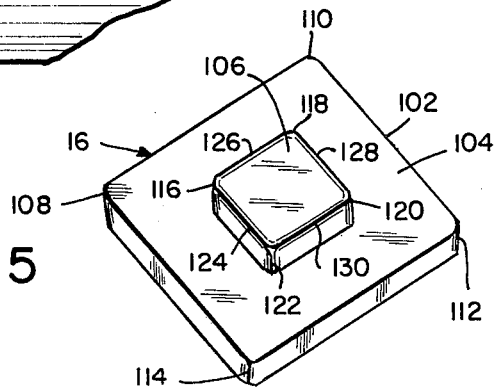
FIG. 5

TABLE GAME

There are well-known types of table games which are similar to the game of tic-tac-toe in which opposing players place game pieces, or markers, upon a rectangular coordinate grid. The first player to complete a row or column or diagonal of the grid with his game pieces is declared the winner. In such games, once a game piece is placed on the grid, it can not be moved and this creates a severe limitation on the complexity of the strategy of the game and its play value. As is well known, the strategy of tic-tac-toe is such that the player who makes the first move can always win or tie. The game of tic-tac-toe is also limited by the use of a three-by-three coordinate grid which limits the total number of locations for placement of a game piece to nine spaces.

It is an object of the present invention to provide a table game in which players strive to complete a row or a column or a diagonal line of a grid, with the table game having increased play value as a result of the ability to move a game piece in a constrained manner after it has been placed on the grid.

Another object of the invention is to provide a table game which can be easily learned, yet which can be played by players of various ages with interest and involvement.

Another object of the present invention is to provide a table game which has a relatively complex strategy yet can be played using easily manipulated game pieces, thereby facilitating play by young children as well as by adults.

Another object of the present invention is to provide a table game in which game pieces can be moved along the rectangular coordinates of an array.

Still another object of the present invention is to provide a table game comprising a relatively small number of component parts which can be easily manufactured in quantity at a relatively low unit cost.

In accordance with the present invention, there is provided a table game which overcomes the limitations of conventional games by permitting the displacement and even the removal of a game piece after it has been placed. The table game includes a game board which is formed on its upper surface with a coordinate array of projections which define therebetween a square array of channels. A plurality of game pieces is provided for each of two players with the game pieces belonging to the two players differentiated by color. Each of the game pieces has a square base and a square boss which fits into and can slide along the channels on the game board. The bases of the game pieces are proportioned so that the game pieces may occupy adjacent channels and a force exerted on a game piece located at the end of a row or column of game pieces causes the entire row or column of game pieces to slide along a channel while leaving other game pieces on the playing board undisturbed.

A transparent cover is provided which is spaced a small distance above the base. This cover enables the players to observe the game pieces, yet prevent the players from inserting a game piece into a row or column except through the end location of that row or column. The transparent cover also constrains the game pieces to slide along the channels of the base and prevents a row or column of game pieces from buckling upward when moved along a channel.

In use, a pair of players alternate in placing game pieces onto the playing board by sliding them into the end portions of the rectangular coordinate array of channels, between the base and the transparent cover. As additional game pieces are added, they cause game pieces already on the base to slide inwardly along the channels. The players are free to enter their game pieces on any of the locations on the perimeter of the array of channels and can thus move their own and their opponents' game pieces along the various rows or columns. The base is constructed so that any row or column can hold up to five game pieces. When a sixth game piece is inserted into a row or column, it causes a game piece at the far end of that row or column to fall off the game board. This enables a player to remove his opponents' game pieces by properly entering his own pieces on the game board. The first player to complete a row, or column or diagonal line of the array, is declared the winner of the game. The ability of a player to move his own and his opponents' game pieces makes the strategy of the game complex and results in a relatively long and interesting game.

Additional objects and advantages of the invention will become apparent during the course of the following specification when taken in connnection with the accompanying drawings, in which:

FIG. 1 is a perspective view of a table game made in accordance with the present invention, showing the manner in which the game is played, with a player's hand inserting a game piece into a row on the game board and thereby causing a game piece located at the other end of the row to fall off the board;

FIG. 2 is a top plan view of the game board and the transparent cover of the table game of FIG. 1, with a portion of the cover broken away to show details of the game board construction;

FIG. 3 is a fragmentary perspective view of the table game of FIG. 1, drawn to an enlarged scale with a hand shown inserting a game piece onto the game board;

FIG. 4 is a fragmentary cross-sectional view of the game board and transparent cover, taken along the line 4—4 of FIG. 2; and FIG. 5 is a perspective view of the bottom of one of the game pieces of the table game.

Referring in detail to the drawings, there is shown in FIG. 1, by way of example, a table game 10 in accordance with the present invention, comprising a playing board or base 12, a transparent cover 14 and a plurality of game pieces 16.

The game board 12 has the general configuration of a truncated pyramid with side walls 18, 20, 22, 24 projecting upwardly from a bottom flange 26 to support a top surface 28. A support member 30, 32, 34, 36 projects upward from each of the four corners 38, 40, 42, 44 of the base 12. The upper surfaces 46 of the support members 30, 32, 34, 36 are notched and recessed to accept the respective corners 48, 50, 52, 54 of the transparent cover 14. These corners 48, 50, 52, 54 of the transparent cover 14 are formed on outwardly-directed projecting portions 56, 58, 60, 62 which are proportioned so that the edges 64, 66, 68, 70 of the transparent cover 14 are generally in alignment with the edges 72, 74, 76, 78 of the top surface 28. The transparent cover 14 includes a centrally located circular hole 80 which enables a user to insert a finger and easily lift the corner 14 off the game board 12. The support members 30, 32, 34, 36 are made of such height that they support the transparent cover 14 in a mounted position in which it is disposed a short distance above the top surface 28 of the game board 12, as is best shown in FIG. 4. This facilitates the placement of game pieces 16 onto the top surface 28 in a manner which will be presently described.

The top surface 28 of the game board 12 has disposed thereon a plurality of upwardly directed projections which, in combination, define a rectangular coordinate array of channels which are arranged in a five-by-five square matrix configuration. The plurality of projections includes a first group of four square projections 82, 84, 86, 88 located, one each, proximate to the four corners 38, 40, 42, 44 of the game board 12 and a group of rectangular projections, with four rectangular projections 90 disposed along each of the four edges 72, 74, 76, 78 of the game board top surface 28. The length of the shorter side of each of the rectangular projections 90 is equal to the length of a side of each of the square projections 82, 84, 86, 88 and the length of the longer sides of each of the rectangular projections 90 is equal to twice the length of a side of each of the square projections 82, 84, 86, 88. The spacing between individual rectangular projections 90 and between the rectangular projections 90 and the square projections 82, 84, 86, 88 is equal to the length of a longer side of a rectangular projection 90.

The plurality of projections further includes a group of sixteen relatively larger square projections 92 which are arranged in a four-by-four matrix array. The sixteen square projections 92 are disposed in alignment with the rectangular projections 90 and the length of the sides of the sixteen square projections 92 are equal to the length of the longer sides of the rectangular projections 90. The plurality of projections, described above, in combination, define a rectangular coordinate array of channels 94 which form a five-by-five matrix configuration. For clarity of illustration, the reference numerals identifying the projections, in FIG. 4, have been placed on the projections or on the transparent cover directly above the projections.

The corners of each of the plurality of projections are rounded when viewed in plan, thereby facilitating the movement of the game pieces 16 on the game board 12, as will be presently described.

The top surface 28 of the game board 12 further includes a five-by-five array of depressions which are identified by the numeral 96 in FIGS. 2, 3 and 4. The depressions 96 are each generally square in configuration and, as best shown in FIG. 4, include inwardly-sloping side walls 98, 100. It is to be understood that although only the two side walls 98, 100 are shown in FIG. 4, each depression 96 is defined by a total of four side walls each similar to the side walls 98, 100. In FIG. 4, for the sake of clarity of illustration, only the depressions which are directly visible as a result of breaking away a portion of the cover 14, are identified with the reference numeral 96.

It is evident that although a five-by-five matrix of channels is shown and described as part of the preferred embodiment, alternative embodiments of the invention may incorporate either a greater or lesser number of channels arranged in a square matrix.

The game pieces used with the table game 10 are best shown in FIG. 5. Each game piece 16, as shown in FIG. 5, comprises a flat square plate 102, the bottom surface 104 of which has a square boss 106 centrally disposed thereon and depending thereform. The corners 108, 110, 112, 114 of the plate 102 and the corners 116, 118, 120, 122 of the boss 106 are rounded. The edges 124, 126, 128, 130 of the boss 106 are also rounded. The square boss 106 is proportioned so that it can lodge, temporarily, in any one of the square depressions 96. The inclined surfaces 98, 100 of the square depressions 96 and the rounded edges 124, 126, 128, 130 of the square boss 106 enable a game piece 16 to be easily pushed along a channel 94, lodge in a square depression 96, and then ride out of the square depression 96 when pushed along by another game piece. The rounded corners of the projections on the top surface 28 of the base 12 and the rounded corners 108, 110, 112, 114, 116, 118, 120, 122 on the game piece 16 prevent jamming of the game pieces 16 as they are moved along the channels 94.

The square plates 102 of the game pieces 16 are proportioned so that when game pieces lodge in adjacent depressions, the edges of the square plates 102 just touch each other.

In order to distinguish between the game pieces 16 belonging to the two players, in the embodiment shown, the game pieces are molded in two different colors. A total of fourteen game pieces are provided for each player, it having been found that this number of game pieces is usually sufficient even for a sustained game in which many game pieces are inserted on the playing baord 12. It is clear that other means such as various markings, indicia, surface treatments or surface contours on the top surface of the game pieces could be used to distinguish between the game pieces belonging to the two players.

An unusual feature in the play of the game is the manner in which the placement of the playing pieces onto the playing board is restricted to insertion from any one of the side edges of the board. The transparent cover 14 in its mounted position prevents the playing pieces from being inserted from above the board, and they may only be inserted from the sides in a horizontal position and along a horizontal plane, through the space between the cover 14 and the top surface 28 of the playing board 12, as shown in FIGS. 2 and 3.

In use, the two players take their game pieces 16 and alternate in inserting them into the channels 94 by sliding them between the transparent cover 14 and the top surface 28 of the base 12 as is shown in FIGS. 1 and 3. The players may insert from any side of the board and may enter any channel 94 whether or not it is occupied. If a game piece 16 occupies the end position of a row or column, a player may enter that row or column simply by using his game piece to push the end game piece further into the row or column. When a row or column is filled with five game pieces, a player inserting an additional game piece into the row or column causes the game piece at the far end of the row or column to slide out of the channel and fall off the playing board, as is shown in FIG. 1.

The depressed areas 96 cause the game pieces to lodge temporarily at the intersections of the channels 94. The transparent cover 14 prevents the game pieces 16 from buckling upward as they slide along the channels 94. The rounded corners on the game pieces and on the projections on the top surface of the game board 12 enable the game pieces 16 to slide along the channels 94 in a relatively smooth manner.

As has been previously indicated, the first player to place five of his game pieces in a row, or a column or a diagonal of the matrix of channels, thereby filling the row, column or diagonal, is declared the winner. At that point the transparent cover 14 is removed using the hole 80 as a finger lift, the game pieces 16 are removed from the base 12, the transparent cover 14 is replaced and play may be resumed.

The ability to slide the game pieces 16 along the channels 94 enables a player, for example, to affect the arrangement of the game pieces in a column either by sliding a game piece onto the end of that column or by sliding a game piece into a row, thereby changing the game piece which is common to both the row and the column. This leads to the creation of various strategies of play. A player can, for example, insert his game pieces into different rows and columns and then introduce game pieces which cause his game pieces to slide into alignment and form a complete row or column.

The players each have the ability to attempt to thwart their opponent's strategies by pushing their opponents' game pieces off the base through the strategic insertion of their own game pieces in appropriate locations. This creates a balance of power between the two players and leads to complexity in the play and a high degree of player interest and amusement.

While a preferred embodiment of the invention has been shown and described herein, it is obvious that numerous omissions, changes and additions may be made in such embodiment without departing from the spirit and scope of the invention.

What is claimed is:

1. A table game comprising a game board having a plurality of upwardly-directed support members, a transparent cover removably mounted on said support members and supported thereby in a position in which it is parallel to and spaced above the upper surface of said game board, a matrix array of channel means disposed on the upper surface of said game board, a first plurality of game pieces identified as belonging to a first player, and a second plurality of game pieces identified as belonging to a second player, each of said game pieces having engaging means for releasably engaging said channel means, each of said playing pieces having end edges positioned to bear against end edges of adjacent game pieces when engaged in said channels, said channel means being of sufficient size to receive and retain columns of playing pieces extending in a first horizontal direction and rows of playing pieces extending in a second horizontal direction perpendicular to said first direction, with the players alternately inserting their respective playing pieces from the sides of the playing board between the upper surface of said playing board and said transparent cover until one player has formed a complete row, column or diagonal line of his inserted playing pieces.

2. A table game according to claim 1 in which said game board further comprises a plurality of projections which define said channel means.

3. A table game according to claim 1 in which said first and second pluralities of game pieces are distinguished from each other by differences in color.

4. A table game according to claim 1 in which first and second pluralities of game pieces are distinguished from each other by means of different color.

5. A table game according to claim 1 in which said game board includes a raised portion on which said matrix array of channel means are disposed.

6. A table game according to claim 1 in which said matrix array comprises a square grid.

7. A table game according to claim 1 in which each of said game pieces comprises a square base member and a square projecting boss centered on said base member.

8. A table game according to claim 3 in which said matrix array of channel means includes a plurality of depressed portions, disposed, one each, at intersections of said channel means, and in which said depressed portions are each proportioned to receive and retain said square projecting boss of each game piece.

9. A table game according to claim 7 in which the corners of said square base members and the corners of said square projecting bosses of said game pieces are rounded.

* * * * *